US011905489B2

(12) United States Patent
Kogel et al.

(10) Patent No.: US 11,905,489 B2
(45) Date of Patent: Feb. 20, 2024

(54) COMPOSITION FOR PRODUCING A LUBRICANT COMPOSITION

(71) Applicant: Carl Bechem GmbH, Hagen (DE)

(72) Inventors: Lutz Kogel, Lippstadt (DE); Patrick Degen, Witten (DE); Tobias Asam, Hagen (DE)

(73) Assignee: Carl Bechem GmbH, Hagen (DE)

( * ) Notice: Subject to any disclaimer, the term of this patent is extended or adjusted under 35 U.S.C. 154(b) by 0 days.

(21) Appl. No.: 17/270,311

(22) PCT Filed: Sep. 10, 2019

(86) PCT No.: PCT/EP2019/074144
§ 371 (c)(1),
(2) Date: Oct. 29, 2021

(87) PCT Pub. No.: WO2020/053232
PCT Pub. Date: Mar. 19, 2020

(65) Prior Publication Data

US 2022/0064565 A1 Mar. 3, 2022

(30) Foreign Application Priority Data

Sep. 10, 2018 (EP) ..... 18193533

(51) Int. Cl.
*C10M 173/02* (2006.01)
*C10N 10/02* (2006.01)

(52) U.S. Cl.
CPC ..... *C10M 173/02* (2013.01); *C10M 2201/02* (2013.01); *C10M 2201/084* (2013.01); *C10M 2201/085* (2013.01); *C10M 2207/022* (2013.01); *C10M 2215/30* (2013.01); *C10M 2223/06* (2013.01); *C10N 2010/02* (2013.01)

(58) Field of Classification Search
CPC .... C10M 2201/0613; C10M 2201/082; C10M 2201/084; C10M 2201/0853; C10M 173/02; C10M 2223/06; C10M 2223/061; C10M 2201/085; C10M 2201/123; C10M 2201/065; C10M 2201/081; C10M 2201/083; C10M 2207/122; C10M 2215/14; C10M 2215/223; C10M 2219/04;
(Continued)

(56) References Cited

U.S. PATENT DOCUMENTS 2,917,459 A 12/1959 Reamer
4,626,367 A 12/1986 Kuwamoto et al.
(Continued)

FOREIGN PATENT DOCUMENTS

DE 1444794 A1 11/1968
EP 1319703 A1 6/2003
(Continued)

OTHER PUBLICATIONS

Communication, dated Mar. 21, 2022, issued by the China National Intellectual Property Administration in Chinese Application No. 201980058866.9.
(Continued)

*Primary Examiner* — Vishal V Vasisth
(74) *Attorney, Agent, or Firm* — Sughrue Mion, PLLC

(57) ABSTRACT

Lubricant composition, in particular a cooling lubricant solution, based on ionic and/or organoelemental compounds.

19 Claims, 2 Drawing Sheets

(58) Field of Classification Search
CPC ..... C10M 2219/042; C10M 2219/044; C10M 2223/04
See application file for complete search history.

(56) References Cited

U.S. PATENT DOCUMENTS

| | | | | |
|---|---|---|---|---|
| 5,030,323 | A | 7/1991 | Awad | |
| 2004/0053793 | A1* | 3/2004 | Li | C10M 173/025 508/389 |
| 2006/0240996 | A1 | 10/2006 | Hayashi et al. | |
| 2016/0160150 | A1* | 6/2016 | Mochizuki | C10M 145/12 427/372.2 |
| 2017/0260471 | A1* | 9/2017 | Lostak | C23C 22/53 |

FOREIGN PATENT DOCUMENTS

| | | | |
|---|---|---|---|
| EP | 2821510 | A1 | 1/2015 |
| GB | 2 003 923 | A | 3/1979 |
| JP | 2002226884 | A | 8/2002 |
| WO | 9808919 | A2 | 3/1998 |
| WO | 02/086038 | A1 | 10/2002 |
| WO | 2015048382 | A1 | 4/2015 |

OTHER PUBLICATIONS

Eyres et al. (Journal of the Institute of Petroleum, 1973, 59 (565): S9-17), cited in Schmierstoffe im Betrieb, 2nd Edition, 2002, S. 546 reference list.

W. Baumann, B. Herberg-Liedtke, Chemikalien in der Metallbearbeitung, Berlin; Heidelberg Springer, 1995, pp. 37-38.

W. Baumann, B. Herberg-Liedtke, Chemikalien in der Metallbearbeitung, Berlin; Heidelberg Springer, 1995, p. 39.

Mibe GmbH: "Gebrauchsinformation—Lbseferron 80,5 mg Brausetanletten", Jan. 3, 2018, XP055645182 (6 pages).

Anonymous, "Eisen(II)-sulfat" Wikipedia, Jun. 28, 2018, XP055645530, (6 pages); http://de.wikipedia.org/w/index.php?title=Eisen (Machine Translation 29 pages).

Written Opinion, dated Dec. 3, 2019, issued by the International Searching Authority in International Application No. PCT/EP2019/074144.

Office Action, dated Sep. 8, 2022, issued by the Chinese Patent Office in Chinese Patent Application No. 201980058866.9.

* cited by examiner

COMPOSITION FOR PRODUCING A LUBRICANT COMPOSITION

CROSS REFERENCE TO RELATED APPLICATIONS

This application is a National Stage of International Application No. PCT/EP2019/074144 filed Sep. 10, 2019, claiming priority based on European Patent Application No. 18193533.9 filed Sep. 10, 2018.

TECHNICAL FIELD

The invention relates to a composition for producing a lubricant composition, to the use of this composition as a performance additive in lubricant compositions, preferably in cooling lubricant compositions, in particular in cooling lubricant solutions, to a lubricant composition and to processes for producing same.

BACKGROUND OF THE INVENTION

Cooling lubricants are often employed in metalworking. The term "cooling lubricant" according to DIN 51385 describes a metalworking medium used in particular for assisting subtractive metalworking processes or forming processes or microstructure influencing (cf. also A. R. Eyres, R. N. Mather, J. Inst. Petr. 59 (565), pp. 9-17, 1973). Cooling lubricants may be subdivided into the primary groups water-immiscible and water-miscible cooling lubricants, wherein the water-miscible cooling lubricants are further distinguished into emulsifiable and water-soluble cooling lubricants.

Cooling lubricants may have a decisive influence on the economy of metalworking processes. Their use may have a considerable influence for example on the lifetime of the employed metalworking tools and/or the quality of the material.

In the contact zone between the material and the tool a cooling lubricant shall ideally have both a cooling and a friction-reducing effect. If cooling is the primary focus it is primarily water-miscible cooling lubricants that are employed. However these often have a poorer lubricating performance and resistance to microorganisms compared to water-immiscible cooling lubricants. They moreover have a propensity for unwanted foaming and are often susceptible to different water qualities (especially in terms of the employed water hardness).

Especially in the case of water-based cooling lubricants it is disadvantageous that unwanted changes in pH occur over the storage and/or usage duration as a result of contact with metallic materials. These may cause additional wear through corrosion and rust. High or low pHs may additionally be damaging to the environment and represent a health hazard.

By contrast, if high lubricating performance is desired water-immiscible, namely oil-based, cooling lubricants tend to be employed. These are characterized especially by their good friction-reducing properties. One disadvantage of the water-immiscible cooling lubricants is that they exhibit low cooling compared to water-miscible cooling lubricants on account of their low specific heat capacity and thermal conductivity. In addition, the components are more difficult to clean after working than when using water-miscible cooling lubricants. A further problem is the oil mist that may occur when using oils, especially at high cutting speeds. The aerosols present therein result in health-hazardous lung contamination. The oil mist may additionally be highly flammable and sufficient safety precautions must therefore be taken.

However, cooling lubricants may also be emulsions which combine the advantageous properties of cooling and friction reduction (W. Baumann, B. Herberg-Liedtke, Chemikalien in der Metallbearbeitung, Berlin; Heidelberg Springer, 1995, p. 370. An emulsion is a disperse system formed by mixing two liquids that are insoluble in one another. They exhibit relatively good lubricating performance and acceptable cooling.

Thus for example European laid-open specification EP 1 319 703 A1 discloses water-based cooling lubricant emulsions for metal forming. These form a lubricating film on the workpiece after drying. The emulsions contain not only water-soluble inorganic salts but also emulsified paraffin wax for friction reduction.

In addition to the high production complexity critical aspects of cooling lubricant emulsions include especially the instability of the emulsion, especially toward introduction of extraneous oil, salt load and water hardness and the colonization of the emulsion by microorganisms.

Attack by fungi and bacteria reduces the anticorrosion characteristics of the emulsions and results in health burdens for personnel. Attack by microorganisms moreover causes the emulsion to lose stability which may result in outages. Similarly to the fully synthetics, emulsions also have a propensity for foaming. It is therefore typical for lubricant emulsions that they contain a multiplicity of auxiliaries such as for example biocides, emulsifiers or defoamers. In addition to the oil phase in emulsions these auxiliaries present a challenge to the care of the emulsion, to occupational safety and to cleaning of the components.

The addition of such auxiliaries not only increases cost and complexity of production of the lubricants but also worsens their $CO_2$ balance. In addition the auxiliaries constitute an additional health burden for the user and the environment since these substances are usually compounds, in particular organic compounds, having a comparatively low molecular mass which are preferentially converted into the gas phase at elevated temperatures such as are customary in subtractive metalworking or forming processes and thus potentially constitute a hazard to health and the environment.

BRIEF SUMMARY OF THE INVENTION

The problem addressed by the present invention is accordingly that of providing a composition for producing a lubricant composition and a lubricant composition which reduces or overcomes at least one of the recited disadvantages.

DETAILED DESCRIPTION OF THE INVENTION

Figure 1:
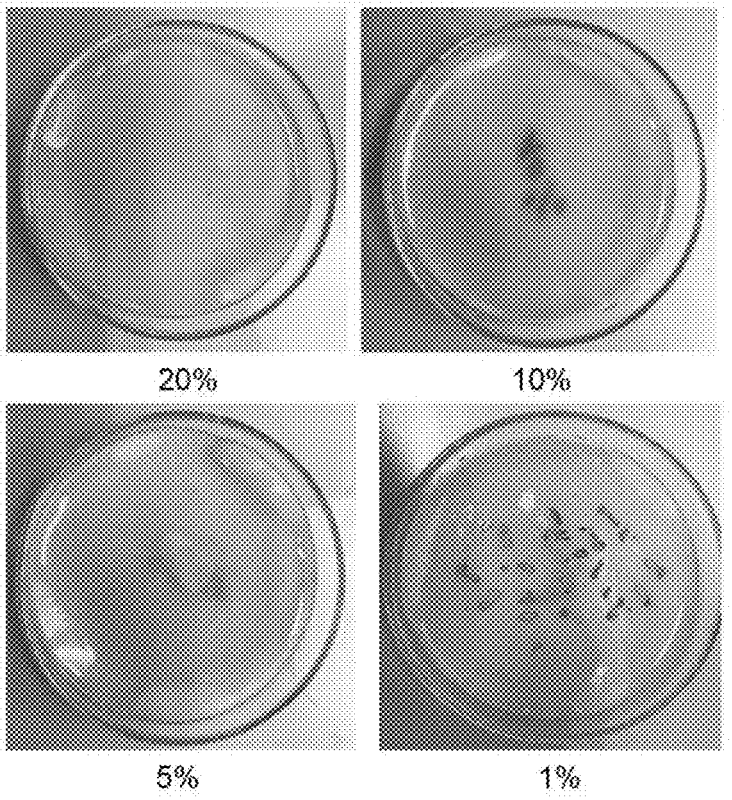
FIG. 1 shows the corrosion properties of the test cooling lubricant solutions according to concentration.

The problem addressed by the present invention is accordingly that of providing a composition for producing a lubricant composition and a lubricant composition which reduces or overcomes at least one of the recited disadvantages.

This problem is solved by the subject matter of Claim 1. Advantageous developments are provided by corresponding dependent claims and further independent claims.

The problem is solved according to the invention by a composition for producing a lubricant composition containing a component (A) and at least one metal salt (M). The component (A) consists of one or more inorganic salts, while the metal in the metal salt (M) is selected from the group consisting of the transition metals, metals of the 3rd main group, metals of the 4th main group, metals of the 5th main group or mixtures thereof. The composition is further characterized in that addition of water at room temperature forms a homogeneous solution.

The component (A) is preferably non-identical to the metal salt (M).

The composition according to the invention may further contain a component (B). The component (B) consists of one or more compounds each containing at least one structural unit XC. Therein, C represents carbon and X represents silicon (Si), nitrogen (N), oxygen (O), phosphorus (P) or sulfur (S). In the structural unit X and C are bonded to one another by means of a σ-bond, π-bond or ionic bond.

The composition may likewise be obtainable by combining the component (A) with at least one metal salt (M), preferably with two metal salts (M). The component (B) is optional. All further preferred embodiments therefore relate to these two embodiments of the composition according to the invention unless otherwise explicitly stated.

The inventors have now found that the composition according to the invention is suitable for providing lubricant compositions exhibiting high lubricating performance coupled with good cooling. The performance of this lubricant composition is comparable with, or even better than, known cooling lubricant emulsions. This was apparent for example upon use in subtractive metalworking or in the forming of metals, in particular of steel and aluminium (cf. Example 3).

These observations were surprising because of the prevailing belief in the art that the lubricity of cooling lubricant solutions is lower than that of cooling lubricant emulsions (W. Baumann, B. Herberg-Liedtke, Chemikalien in der Metallbearbeitung, Berlin; Heidelberg Springer, 1995, p. 39).

The lubricant compositions provided according to the invention additionally have the advantage over the prior art that they require less, if any, auxiliaries and/or additional performance additives to achieve the desired lubricating performance. For instance they exhibit good biostability even without addition of biocides (cf. Example 7). The use of defoamers may also be eschewed (cf. Example 6).

The possible redox reactions upon contacting of a metallic material with an aqueous medium can be surprisingly limited, preferably even inhibited, by addition of a metal salt (M). The metal salt (M) functions as an "electronic buffer". By shifting the equilibrium of the first reaction in equation 1 (see below) to the side of the elemental metal in the material the further possible reactions of free electrons ($e^-$) are suppressed/prevented. This phenomenon is familiar to a person skilled in the art as Le Chatelier's principle. This has the result that the pH of the lubricant compositions according to the invention is stabilized. It preferably remains essentially constant over the usage and storage duration of the composition (cf. Tables 4-6).

The composition according to the invention moreover makes it possible to reduce the proportion of pH stabilizer auxiliaries or even eschew them altogether.

Reducing the use of auxiliaries is associated with the advantage of reduced environmental impact as a result of an improved $CO_2$ balance and a reduced health risk to the environment and the user.

A further advantage of the composition according to the invention is the easier separation of extraneous oil from a lubricant composition produced with the composition. This applies especially when a lubricant solution is concerned. If during use the liquid lubricant, in particular the cooling lubricant solution, is contaminated with extraneous oils this may be easily skimmed off. Oils generally have a lower density than water and are practically insoluble to insoluble in water. Oils and/or fats thus preferably collect at the surface of the lubricant solution and may be easily removed from there.

Further experiments also demonstrated that the lubricant composition according to the invention, in particular the cooling lubricant solution, exhibits a certain insensitivity towards different hardnesses of the water (Example 5).

The term "water hardness" is to be understood as meaning the concentration of the salts of alkaline earth metals, in particular of alkaline earth metal ions, preferably of calcium and magnesium, dissolved in water. If the concentration of alkaline earth metals is high—i.e. the water is very hard—the ions present therein may react with ionic compounds present in the lubricant composition. A high sensitivity to hard water is observed in the case of cooling lubricant emulsions in particular since the emulsions generally contain emulsifiers (for example fatty acids). These may react with the alkaline earth metal ions. This often results in the formation of unwanted deposits which may adversely affect the performance of the cooling lubricants. This necessitates complex softening processes which may result in elevated costs of the lubricant.

Since the compositions according to the invention contain only components which are water-soluble and form a homogeneous solution in water lubricant compositions formed therewith preferably contain no emulsifiers. They therefore exhibit a greater insensitivity to undesired reactions with alkaline earth metal ions from hard water. The formation of disadvantageous deposits or an associated loss of performance can therefore be reduced. In addition, complex softening processes may be eschewed.

In the context of the invention the term "solution" is defined as a homogeneous distribution of molecularly dispersed particles in a liquid medium. All particles are molecularly dispersed therein. They therefore all form a common phase. A solution is thus distinguished from a system consisting of a plurality of phases, wherein one phase is the dispersion medium in which the other phases are distributed (i.e. dispersed), for example an emulsion or suspension.

The composition according to the invention is thus also characterized in that after combining with water said composition does not form an emulsion or suspension nor forms or contains a mini-, nano- or microemulsion. Nor are micelles, vesicles or mesophases, for example lamellar systems, present after addition of water.

XC compounds (C=carbon; X as defined below) in the context of the invention are compounds comprising at least one element (X)-carbon (C) bond. They may also be referred to as "organoelemental compounds". The bond between X and C comprises compounds having an element-carbon σ-bond, π-bond or else ionic bond. The elements (X) of the element-carbon bonds are independently of one another selected from silicon (Si), nitrogen (N), oxygen (O), phosphorus (P) or sulfur (S).

If the compositions according to the invention comprise a plurality of salts and/or organoelemental compounds these may interact and/or react with one another. Ion exchange reactions in particular are possible in the case of inorganic or organoelemental salts.

A composition according to the invention preferably comprises an inorganic salt of the component (A), at least one metal salt (M) and optionally at least one compound of the component (B).

In a preferred embodiment the compositions according to the invention are therefore obtainable by combination of at least two inorganic salts of the component (A) with at least two metal salts (M) and optionally one or more compounds of the component (B) as defined herein or of at least one inorganic salt of the component (A) with at least one metal salt (M) and optionally at least one compound of the component (B) as defined herein.

In a preferred embodiment the composition according to the invention contains not only the component (A) and at least one metal salt (M) but also the component (B). It is particularly preferable when the composition according to the invention consists of these components. However, it is very particularly preferable when the composition according to the invention consists of component (A) and at least one metal salt (M). It is very particularly preferable when the metal salt (M) is distinct from component (A).

When these compositions are used for producing a lubricant composition the composition itself—i.e. without further additives, auxiliaries or solvents—may constitute the lubricant composition. The composition may be employed as a lubricant composition in solid or liquid form. However, to produce the lubricant composition the composition may also be admixed with further constituents, for example additives such as a corrosion inhibitor or a pH regulator, optionally in addition to a solvent (cf. hereinbelow).

The fact that the components (A) and the component (B) each for themselves and also together form a homogeneous solution upon addition of water means that they are additionally characterized in that the surface tension of water changes only slightly, if at all, upon addition of the composition to water. In a preferred embodiment the surface tension of water changes by not more than 10%, preferably by not more than 7.5%, particularly preferably by not more than 5% and in particular by not more than 2% due to addition of the component (A) or the component (B) or mixtures thereof.

The "surface tension" is also referred to as specific surface energy. It is a force which in liquids interfacing with a gas or with vacuum acts tangentially to the interface. Surface tension of liquids may be markedly altered by the addition of certain substances. Measurement of the change in surface tension is known to those skilled in the art. Said measurement may be carried out for example according to the following standards: ASTM D 1331; ISO 6889; DIN EN 14210.

A preferred method for determining surface tension is the bubble pressure method based on ASTM D 3825 and the droplet volume method based on ASTM D 2285 (see also Example 2).

A particularly preferred aspect of the invention relates to the use of the composition according to the invention as a performance additive for producing a lubricant composition, in particular for subtractive metalworking or for forming processes. A performance additive is to be understood as meaning a composition of matter which improves the lubricating performance of a lubricant composition in lubricating performance-oriented performance tests such as for example the four-ball apparatus (VKA) for determining weld load according to DIN 51350-2 and/or the cross-cylinder test for determining the Reichert value (cf. Example 3).

It may be especially advantageous when the lubricant composition contains no further performance additive.

In a preferred embodiment the composition or the lubricant composition contains no oil, wax or fat, in particular no mineral oil, synthetic oil, plant oil or animal fat. The composition or lubricant composition is preferably therefore free from oil, wax or fat, especially free from natural or synthetic wax, in particular free from microcrystalline wax, paraffin wax, polyethylene wax, polypropylene wax, carnauba wax or mixtures thereof.

It is also preferable when the composition and lubricant composition contains no solid constituents, for example resins.

Without wishing to be bound to a particular scientific theory the good lubricating performance of the composition according to the invention and of the lubricant composition produced with this composition might be attributable to an interaction between the metal surface and the inorganic salts and/or the organoelemental compound. A tribologically active layer may be formed by physisorption or chemisorption between the metal surface and the composition according to the invention. The viscosity of the composition does not appear to play a decisive role in lubricating performance.

As previously elucidated the inventors have found that addition of a metal salt (M) causes the pH of the lubricant composition according to the invention to remain stable for longer. It is accordingly possible to utilize Le Chatelier's principle and suppress metal oxidation through addition of metal ions by addition of at least one metal salt (M) "appropriate" to the metal of the material (cf. equation 1). It is important to match the metal salt (M) to the metal in the employed material in order that a suitable redox system (according to Le Chatelier) may be formed. Accordingly, at least one water-soluble iron salt is preferably to be selected if the main constituent in the material is iron (for example in steel or other alloys of iron). The metal salt in the composition according to the invention thus functions as an electronic buffer.

A reaction of a metallic material in contact with an aqueous medium (which contains ions as a result of salt addition and/or naturally) initially results in oxidation of the metal in the material to a higher oxidation number of the metal and, through further reaction with protons of the dissociated water, finally affords elemental hydrogen. This escapes from the aqueous medium and leaves behind an excess of hydroxide ions (see equation 1, see below).

Equation 1 below shows a possible reaction using the example of a material containing iron. In the example shown the elemental iron)($Fe^0$) reacts with a phosphate ion present in the aqueous medium ($PO_4^{3-}$) by electron donation ($e^-$) to afford iron(III) phosphate ($Fe^{3+}PO_4$). The forward and reverse reactions (reduction/oxidation) are in equilibrium. Due to the autodissociation of water the solution also contains protons (H+) and hydroxide ions ($OH^-$) which are likewise subject to an equilibrium reaction (on the side of water ($H_2O$)). A further reaction of the free electrons ($e^-$), here from the oxidation reaction of the iron, with protons ($H^+$) from the water forms hydrogen which escapes from the aqueous medium. The hydroxide ions remain in the solution—the pH of the aqueous medium increases.

$$Fe^0(s)+PO4^{-3} \rightleftharpoons Fe^3PO_4(l)+3e^-$$

$$H_2O \rightleftharpoons H^+ + OH^-$$

$$3H^+ + 3e^- \rightarrow 1.5H_2\uparrow \qquad \text{Equation 1:}$$

The term "adsorption" is to be understood as meaning the attachment of atoms or molecules to a surface. Depending on the type of bonding forces between the atom or molecule and the surface a distinction is made between physisorption and chemisorption.

"Physisorption" is a weak adsorption on surfaces comparable in strength to van der Waals forces in molecules. The electronic structures of the adsorbate and the surface remain largely unchanged in physisorption.

The term "chemisorption" describes a type of adsorption on surfaces in which the adsorbed molecules adhere to the surface of the solid by means of a chemical bond. Accordingly, the electronic structures of the adsorbate and the surface are altered in the case of chemisorption.

Particularly advantageous embodiments of the invention are hereinbelow elucidated in more detail.

In addition to the advantages resulting from adjustment of the weight ratio between components (A) and (B) it is likewise advantageous when the components (A) and (B) each have a solubility in water at 25° C. of at least 25 g/L, preferably of at least 50 g/L, more preferably of at least 100 g/L, particularly preferably of 200 g/L, especially preferably of at least 500 g/L.

The "solubility" of a substance denotes the extent to which a pure substance may be dissolved in a solvent. It may also be reported as a ratio of substance mass to volume of the solution. The units of solubility are g/L.

In a further preferred embodiment the component (A) contains inorganic salts comprising sulfur (S), nitrogen (N), phosphorus (P) or mixtures thereof. Preferred compositions are those in which the component (A) contains sulfur (S) or phosphorus (P) or mixtures thereof.

Advantageous compositions are especially those in which the component (A) contains a group selected from sulfide, sulfite, sulfate, thiosulfate, disulfite, tetrathionate, ammonium, nitride, nitrate, phosphide, phosphite, phosphate, diphosphate, polyphosphate, pyrophosphate, metaphosphate or salts or mixtures thereof. The component (A) especially preferably contains a group selected from the group consisting of sulfite, disulfite, thiosulfate, phosphate, polyphosphate, pyrophosphate, metaphosphate or salts or mixtures thereof; the component (A) especially preferably contains a group selected from the group consisting of sodium sulfite, sodium disulfite, sodium thiosulfate, sodium phosphate, sodium tripolyphosphate, sodium pyrophosphate, sodium hexametaphosphate or mixtures thereof.

The component (B) is by preference selected from the group consisting of organophosphorus, organosulfur, organonitrogen compounds or mixtures thereof, preferably from organophosphorus, organosulfur compounds or mixtures thereof, more preferably from organophosphorus or organosulfur compounds, particularly preferably from organophosphorus compounds.

In a particularly preferred embodiment the component (B) contains at least one group selected from the group consisting of sulfate, thiosulfate, disulfite, tetrathionate, sulfonate, phosphate, phosphonate, bisphosphonate, oligophosphonate, polyphosphonate, ammonium or salts or mixtures thereof, preferably from sulfate, sulfonate, phosphate, phosphonate, bisphosphonate, oligophosphonate, polyphosphonate or salts or mixtures thereof, more preferably sulfonate, phosphate, phosphonate, bisphosphonate, oligophosphonate, polyphosphonate or salts or mixtures thereof, particularly preferably phosphonate, bisphosphonate, oligophosphonate, polyphosphonate or salts or mixtures thereof; in particular component (B) is selected from the group consisting of bisphosphonates or salts thereof.

The term "phosphonate" refers to compounds of structural formula R—$PO(OH)_2$, wherein R is preferably an organic radical. R is preferably selected from the group of alkyl, alkenyl or aryl radicals, particularly preferably from optionally functionalized radicals containing N, P, O or S. The optionally functionalized phosphonates may in particular be aminophosphonates.

Oligophosphonates are compounds containing the structural unit —$[P(O)ORO]_n$—. The parameter n is the number of repeating units. For oligophosphonates this is in the range from 3 to 20.

The term "polyphosphonate" describes compounds having the structural unit —$[P(O)ORO]_n$— wherein polyphosphonates have more than 20 repeating units n.

It has been found that cooling lubricants or cooling lubricant solutions having particularly advantageous properties are obtainable when component (B) contains bisphosphonates.

The use of 1,1-diphosphonic acids or salts thereof, in particular 1-hydroxyethane-1,1-diphosphonic acid or salt thereof (i.e. etidronic acid) has preferably proven advantageous.

In a very particularly preferred embodiment of the invention component (B) is therefore selected from the group consisting of 1-hydroxyalkane-1,1-diphosphonic acid, 1-hydroxyalkene-1,1-diphosphonic acid, 1-aminoalkane-1,1-diphosphonic acid, 1-hydroxy-3-aminoalkane-1,1-diphosphonic acid, 3-amino-1-hydroxyalkane-1,1-diphosphonic acid, 1-hydroxy-4-aminoalkane-1,1-diphosphonic acid, 1-amino-4-hydroxyalkane-1,1-diphosphonic acid, alkylamino-1-hydroxyalkane-1,1-diphosphonic acid or salts thereof or mixtures thereof, preferably 1-hydroxyalkane-1,1-diphosphonic acid, 1-aminoalkane-1,1-diphosphonic acid, 3-amino-1-hydroxyalkane-1,1-diphosphonic acid, 1-hydroxy-3-aminoalkane-1,1-diphosphonic acid, alkylamino-1-hydroxyalkane-1,1-diphosphonic acid or salts thereof or mixtures thereof, more preferably 1-hydroxymethane-1,1-diphosphonic acid, 1-hydroxyethane-1,1-diphosphonic acid, 1-hydroxypropane-1,1-diphosphonic acid, 3-amino-1-hydroxypropane-1,1-diphosphonic acid, 1-hydroxybutane-1,1-diphosphonic acid, 1-hydroxy-3-aminopropane-1,1-diphosphonic acid, 4-dialkylamino-1-hydroxybutane-1,1-diphosphonic acid or salts thereof or mixtures thereof, particularly preferably 1-hydroxyethane-1,1-diphosphonic acid, 1-hydroxypropane-1,1-diphosphonic acid, 3-amino-1-hydroxypropane-1,1-diphosphonic acid or salts thereof or mixtures thereof, in particular 1-hydroxyethane-1,1-diphosphonic acid.

The term "alkane" refers to an organic hydrocarbon compound of general formula $C_nH_{2n+2}$. The term "alkane" is used to refer to molecules to indicate that the main chain of the molecule at issue is concerned. The term "alkane" also includes substituted alkanes unless otherwise explicitly stated.

"Alkene" refers to an organic hydrocarbon compound of general formula $C_nH_{2n}$ containing at least one double bond. The term "alkene" also includes optionally substituted alkenes unless otherwise explicitly stated.

"Optionally substituted" is to be understood as meaning that hydrogen atoms may be replaced by substituents in the corresponding molecule or in the corresponding radical. When a molecule is substituted either all of the hydrogen atoms may be replaced by substituents or only some of the hydrogen atoms are replaced by substituents.

The term "alkyl" refers to a portion of a molecule consisting of carbon atoms and hydrogen atoms. Alkyl radicals have the general formula —$C_nH_{2n+1}$. The term "alkyl" derives from the "alkane" upon which it is based and from which a hydrogen atom has been notionally removed. The term "alkyl" is used in the nomenclature to indicate that a side chain of the molecule is concerned. "Alkyl" also includes optionally substituted alkyl radicals, even if not specifically indicated.

The term "alkenyl" radical refers to a portion of a molecule consisting of optionally substituted carbon atoms and hydrogen atoms. For example an alkenyl group having a double bond in particular has the general formula —$C_nH_{2n+1}$. However, alkenyl groups may also have more than one double bond. The number of hydrogen atoms varies according to the number of double bonds in the alkenyl group. Examples of alkenyl groups are vinyl-, allyl-, 2-butenyl- and 2-hexenyl-.

"Aryl" radical refers to a portion of a molecule containing an aromatic group. An "aromatic group" refers to cyclic, planar hydrocarbons having an aromatic system. The aromatic group may in particular be monocyclic, bicyclic or tricyclic. An aromatic group may further also contain heteroatoms selected from the group consisting of N, O, P and S. Examples of aromatic groups are benzene, naphthalene, anthracene, phenanthrene, furan, pyrrole, thiophene, isoxazole, pyridine and quinoline, wherein in the aforementioned examples the necessary number of hydrogen atoms has in each case been removed to allow incorporation into the corresponding structural formula. For example in a structural formula HO—R*—$CH_3$, wherein R* is an aromatic group having 6 carbon atoms, in particular benzene, two hydrogen atoms would have been removed from the aromatic group, in particular from benzene, to allow incorporation into the structural formula.

According to the invention the term "electronic buffer" is to be understood as meaning at least one compound comprising at least one, preferably at least two, metal salts. Such an electronic buffer preferably equalizes the pH of the composition containing it. For example introduction of oxygen or the influence of the aqueous solution on the metallic material alters the pH of cooling lubricants or cooling lubricant solutions and these changes/variations thus result in a higher or lower undesired pH (see above). These pH instabilities may be limited or prevented according to the invention by addition of at least one metal salt (M).

According to the invention "metal salt" is to be understood as meaning a compound including an anion and a cation, wherein the cation is preferably a metal cation selected from the group of metals, preferably selected from the group consisting of transition metals, metals of the 3rd main group, metals of the 4th main group, metals of the 5th main group or mixtures thereof.

The anion is preferably selected from the group consisting of sulfide, sulfite, sulfate, thiosulfate, disulfite, tetrathionate, ammonium, nitride, nitrate, phosphide, phosphite, phosphate, diphosphate, polyphosphate, pyrophosphate, metaphosphate, carbonate, halide, cyanide, manganate, chromate or mixtures thereof.

The term "metals" includes all metals of the 3rd to 6th main group, alkali metals, alkaline earth metals, metalloids and transition metals in the periodic table of the elements and also their ions.

Where according to the invention reference is made to a metal as such or to a specific metal, for example iron, this is to be understood as also including the respective ion.

The abbreviations for the respective elements (as per the abbreviations from the periodic table), for example Fe or Cu, are according to the invention to be understood as meaning the corresponding element, here iron or copper, and/or its ions.

"Metalloids" are elements of groups Ill to VI of the periodic table. These include boron, silicon, germanium, arsenic, antimony, selenium, tellurium, polonium, astatine. Where according to the invention reference is made to metalloids this is always to be understood as also including their ions.

"Transition metals" are elements of the periodic table having the atomic numbers 21 to 30, 39 to 48, 57 to 80 and 89 to 112. Where according to the invention reference is made to transition metals this is always to be understood as also including their ions.

In a particularly preferred embodiment the composition according to the invention comprises at least one metal salt (M). A metal salt (M) comprises at least one metal/metal ion and at least one counterion.

Advantageous compositions are especially those in which at least one metal salt (M) contains a counterion selected from the group consisting of sulfide, sulfite, sulfate, thiosulfate, disulfite, tetrathionate, ammonium, acetate, citrate, oxalate, cyanide, iodide, bromide, chloride, fluoride, nitride, nitrate, phosphide, phosphite, phosphate, diphosphate, polyphosphate, pyrophosphate, orthophosphate, metaphosphate or mixtures thereof, preferably from sulfate, ammonium, acetate, citrate, oxalate, orthophosphate, phosphate or mixtures thereof and a metal/metal ion selected from the group consisting of Al, Ga, In, TI, Sn, Pb, Sb, Bi, Ti, V, Cr, Mn, Fe, Co, Ni, Cu, Zn, Zr, Nb, Mo, Ru, Rh, Pd, Ag, Cd, Ta, W, Re, Os, Ir, Pt or Hg or mixtures thereof, preferably from Al, Sn, Ti, V, Cr, Mn, Mo, Fe, Co, Ni, Cu or mixtures thereof, particularly preferably from Al, Sn, Fe, Cr, Cu, W or Ni, very particularly preferably is Fe.

According to the invention the term "counterion" is to be understood as meaning the charge-equalizing counterion to a particular ion. A counterion may be either a cation or an anion. According to the invention the counterion is preferably selected from the group consisting of sulfide, sulfite, sulfate, thiosulfate, disulfite, tetrathionate, ammonium, acetate, citrate, oxalate, cyanide, iodide, bromide, chloride, fluoride, nitride, nitrate, phosphide, phosphite, phosphate, diphosphate, polyphosphate, pyrophosphate, orthophosphate, metaphosphate or mixtures thereof.

Particularly preferred compositions are those containing the component (A) selected from the group consisting of sulfite, disulfite, thiosulfate, phosphate, polyphosphate, pyrophosphate, metaphosphate or mixtures thereof, at least one metal salt (M) selected from the group consisting of sulfide, sulfite, sulfate, thiosulfate, disulfite, tetrathionate, ammonium, acetate, citrate, oxalate, cyanide, iodide, bromide, chloride, fluoride, nitride, nitrate, phosphide, phosphite, phosphate, diphosphate, polyphosphate, pyrophosphate, orthophosphate, metaphosphate or mixtures thereof and optionally the component (B) selected from sulfonate, phosphate, phosphonate, bisphosphonate or mixtures thereof.

The component (A) is preferably distinct from the metal salt (M).

In a particularly advantageous embodiment the composition contains the component (A) selected from the group consisting of sulfite, disulfite, thiosulfate, phosphate, polyphosphate, pyrophosphate, metaphosphate or mixtures thereof, at least one metal salt (M) selected from the group consisting of sulfate, ammonium, acetate, citrate, oxalate, orthophosphate, phosphate or mixtures thereof and optionally the component (B) selected from the group consisting of 1-hydroxyethane-1,1-diphosphonic acid, 1-hydroxypropane-1,1-diphosphonic acid, 3-amino-1-hydroxypropane-1,1-diphosphonic acid or salts thereof or mixtures thereof.

More preferred compositions are those containing the component (A) selected from the group consisting of alkali metal sulfite, alkali metal disulfite, alkali metal thiosulfate, alkali metal phosphate, alkali metal tripolyphosphate, alkali metal pyrophosphate, alkali metal hexametaphosphate or mixtures thereof, at least one metal salt (M) selected from the group consisting of sulfate, ammonium, acetate, citrate, oxalate, orthophosphate, phosphate or mixtures thereof and the optional component (B) selected from etidronic acid, sodium etidronate, potassium etidronate or mixtures thereof.

Yet more preferred compositions are those containing the component (A) selected from the group consisting of potassium sulfite, potassium disulfite, potassium thiosulfate, potassium phosphate, potassium tripolyphosphate, potassium pyrophosphate, potassium hexametaphosphate or mixtures thereof, at least one metal salt (M) selected from the group consisting of sulfate, ammonium, acetate, citrate, oxalate, orthophosphate, phosphate or mixtures thereof and the optional component (B) selected from etidronic acid, sodium etidronate, potassium etidronate or mixtures thereof.

In a preferred embodiment the composition according to the invention comprises at least one metal salt (M) selected from the group consisting of iron sulfate, iron orthosulfate, ammonium iron sulfate, ammonium iron citrate, ammonium iron oxalate, iron citrate, iron oxalate and/or hydrates thereof or mixtures thereof.

In a further preferred embodiment the composition according to the invention comprises a component (A) selected from the group consisting of alkali metal sulfite, alkali metal disulfite, alkali metal thiosulfate, alkali metal phosphate, alkali metal tripolyphosphate, alkali metal pyrophosphate, alkali metal hexametaphosphate or mixtures thereof and at least one metal salt (M) selected from the group consisting of iron sulfate, iron orthosulfate, ammonium iron sulfate, ammonium iron citrate, ammonium iron oxalate, iron citrate, iron oxalate and/or hydrates thereof or mixtures thereof.

In a particularly preferred embodiment the composition according to the invention comprises a phosphate salt, in particular potassium tripolyphosphate, as component (A) and at least one metal salt (M) selected from the group consisting of iron sulfate, iron orthosulfate, ammonium iron sulfate, ammonium iron citrate, ammonium iron oxalate, iron citrate, iron oxalate and/or hydrates thereof or mixtures thereof.

In a very particularly preferred embodiment the composition according to the invention comprises a phosphate salt, in particular potassium tripolyphosphate, as component (A) and at least one metal salt (M) selected from the group consisting of iron sulfates and/or hydrates thereof or mixtures thereof.

In a particularly preferred embodiment the composition according to the invention comprises at least two metal salts (M) based on the aforementioned definitions.

In a further particular embodiment the composition according to the invention comprises at least two metal salts (M), wherein these differ in terms of the oxidation number of the metal and/or in terms of the corresponding counterion(s).

It is further preferred according to the invention when a composition according to the invention comprises at least two metal salts (M) wherein one metal salt includes a metal of oxidation state (II+) and the other metal salt includes a metal of oxidation state (III+).

It is very particularly preferable when a composition according to the invention comprises a metal salt (M) including a metal Fe(II+) and a further metal salt (M) including a metal Fe(III+).

Particularly advantageous compositions according to the invention are those in which two different metal salts (M) are present in a ratio between 10:1 and 1:10, preferably between 5:1 and 1:5, particularly preferably between 2:1 and 1:2.

Advantageous compositions are especially those in which the metal salt (M) which includes Fe(II+) is present in a ratio of up to 5:1, preferably of 5:1, relative to a second metal salt (M) which includes Fe(III+).

Particularly advantageous compositions according to the invention are further those in which the metal salt (M) which includes Fe(II+) is present in a ratio of up to 3:1, preferably of 3:1, relative to a second metal salt (M) which includes Fe(III+).

Very particularly advantageous compositions according to the invention are those in which the metal salt (M) which includes Fe(II+) is present in a ratio of up to 2:1, preferably of 2:1, relative to a second metal salt (M) which includes Fe(III+).

In an alternative embodiment of the invention the composition contains not only the component (A) and at least one metal salt (M) but also the component (B). It was found that compositions having particularly advantageous properties result when at least 40% by weight of the component (A), preferably at least 50% by weight of the component (A), more preferably at least 60% by weight of the component (A), particularly preferably at least 80% by weight of the component (A), in particular at least 90% by weight of the component (A), based on the total weight of the components (A) and (B) is present.

The weight ratio of the components (A) and (B) is preferably in the range between 40:60 to 95:5.

In a further preferred embodiment the weight ratio of the components (A) and (B) is at least 40:60, preferably at least 50:50, more preferably at least 60:40, particularly preferably at least 70:30, in particular at least 80:20.

In a particular aspect of the invention the above-described compositions comprise exclusively solids. In a preferred embodiment the compositions are accordingly solid compositions. These may be in any desired form, for example in the form of a powder or granulate.

It may be advantageous to compact the composition according to the invention into solid form. This is the case especially for powder. Compacting may employ conventional compacting methods such as for example cold pressing, sintering, hot pressing or rolling. Granulates may be obtained by customary processes such as moist granulation or dry granulation.

The compositions may be employed as lubricants without further processing or employed as a cooling lubricant for example after dilution with a solvent, preferably water.

If the composition is in solid form it may be advantageous to process these into tablets ("tabs").

The tablets may be obtained from granulates or powder by customary compression methods.

This embodiment especially facilitates transport and storage of the composition before further processing thereof into lubricant compositions.

In one embodiment of the invention the tablet additionally contains a disintegrant. Customary disintegrants are familiar to those skilled in the art in this field. Preferred disintegrants are for example selected from the group consisting of starch, cellulose derivatives, alginic acids, dextrans and crosslinked polyvinylpyrrolidones as well as gas-evolving compositions of matter such as for example sodium hydrogen carbonate and citric or tartaric acid or mixtures thereof.

In addition to the compositions the invention therefore also relates in a particular aspect to a process for providing a solid composition for producing a lubricant composition comprising the steps of:

(i) providing a composition containing the components (A) and/or (B) and at least one metal salt (M), preferably (A) and (B) and at least two metal salts (M);
(ii) compacting this composition, for example by roller compaction;
(iii) granulating the lubricant composition and
(iv) compressing the granulates into tablets.

The compositions according to the invention in solid form, preferably in the form of a powder, granulate or—particularly preferably—in the form of tablets, can form a lubricant composition, in particular a cooling lubricant for metalworking, in particular for subtractive metalworking, by addition of water.

The invention accordingly also relates in a further aspect to the use of a composition according to the invention for producing a lubricant solution, in particular a cooling lubricant solution, preferably for subtractive metalworking. This composition is preferably in the form of a tablet or in the form of a powder. The tablet may in particular be produced as described herein.

However, the composition may also be directly employed for producing a lubricant composition without compacting or further processing. To this end said composition is preferably mixed with water, in particular only with water.

Different cooling lubricant compositions may be produced by establishing a particular ratio between the composition and water. A lubricant composition containing at least 80% by weight of water is particularly advantageous. Said composition exhibits consistently good cooling.

In a particularly preferred embodiment of the invention the lubricant composition contains at least 85% by weight of water, more preferably at least 90% by weight of water, especially preferably at least 95% by weight of water. The upper limit for water is typically 99% by weight.

The cooling lubricants according to the invention having a high water content have proven particularly advantageous for use in subtractive metalworking. Especially cooling lubricants containing a cooling liquid having a high enthalpy of vaporization are preferred here. The "enthalpy of vaporization" refers to the heat required to convert a defined amount of liquid from the liquid to the gaseous state (i.e. for vaporization). Water has a standard enthalpy of vaporization (25° C.) of 43 kJ/mol. This is particularly high compared to many other liquids, i.e. the liquid can absorb a particularly large amount of energy, for example in the form of heat, before being converted into the gaseous state.

In one embodiment of the invention the concentration of component (A) and/or component (B) in the case of the lubricant compositions according to the invention is in the range from 1% to 20% by weight, preferably 1% to 15% by weight, particularly preferably 5% to 10% by weight, based on the total weight of the lubricant composition.

Alternative lubricant compositions having a higher concentration of component (A) and/or component (B) in the range from 25% to 95% by weight are also referred to as concentrates in the context of the invention. In a preferred embodiment of the invention the concentration of component (A) and/or component (B) is therefore 25% to 95% by weight, preferably 30% to 80% by weight, particularly preferably 35% to 60% by weight.

In a preferred lubricant composition according to the invention the total concentration of the metal salts or of the metal salt (M) is in the range from 0.1% to 10% by weight, preferably 0.25% to 8% by weight, particularly preferably 0.5% to 5% by weight, very particularly preferably 0.8% to 2.5% by weight, based on the total weight of the lubricant composition.

In a preferred embodiment the total concentration of the metal ions is in the range from 1000-10000 ppm, preferably 2000-8000 ppm, particularly preferably 3000 to 7000 ppm, very particularly preferably >5000 ppm. This applies in particular to the use of one or more iron salts.

In addition to the composition according to the invention the lubricant composition may comprise customary additives which are selected according to the particular field of application of the lubricant and may be added to improve selected properties of the lubricant composition according to the invention. The auxiliaries are advantageously water-soluble. The lubricant composition therefore also advantageously forms a homogeneous solution even after addition of the auxiliaries. The particularly preferred lubricant compositions are thus likewise solutions.

However, the invention also captures lubricant compositions that are in the form of dispersions or colloidal dispersions, optionally also emulsions, after addition of auxiliaries. In addition to the components (A) and/or (B), preferably (A) and (B), which in any case afford a homogeneous solution upon addition of water the invention thus also captures lubricant compositions containing surface-active substances such as for example wetting agents or emulsifiers.

The lubricant compositions according to the invention may in particular contain anticorrosion agents. These are preferably selected from the group consisting of triazoles, thiadiazoles, organophosphoric acids, boric acid, boric acid derivatives, sulfonic acids, sulfonates, sulfonic acid esters, carboxylic acids or mixtures thereof. Preferred examples include benzotriazole, benzothiadiazole, maleic acid, malonic acid, isononanoic acid, citric acid, ascorbic acid or mixtures thereof.

The anticorrosion agent is preferably present in the lubricant composition in an amount of not more than 10% by weight, preferably not more than 5% by weight, more preferably not more than 2% by weight, particularly preferably not more than 1% by weight, in particular not more than 0.1% by weight, based on the total weight of the lubricant composition.

It has been found that lubricant compositions containing organoelemental compounds, in particular bisphosphonates such as etidronic acid, exhibit good corrosion properties with addition of only small amounts, if any, of anticorrosion agent. This is attributable to the fact that these compounds can themselves have an anticorrosive effect. This applies especially to bisphosphonates such as etidronic acid.

In a particularly preferred embodiment the anticorrosion agent is therefore present in the lubricant composition containing component (B), preferably bisphosphonate, particularly preferably etidronic acid and salts or mixtures thereof, in particular etidronic acid, sodium etidronate and potassium etidronate or mixtures thereof, in an amount of not more than 2% by weight, preferably not more than 1% by weight, particularly preferably not more than 0.1% by weight, in particular not more than 0.01% by weight, based on the total weight of the lubricant composition.

Nonferrous inhibitors may also be present. Customary nonferrous inhibitors are familiar to those skilled in the art in this field. These are preferably selected from the group consisting of glycols, alkanolamines, aliphatic and aromatic carboxylic acids, carboxylic and sulfonic amides, esters, heterocycles, thiols of heterocycles, triazoles, in particular benzotriazole and tolyltriazole, imidazoles, in particular benzimidazole or mixtures thereof, particularly preferably benzotriazole.

pH regulators may also be present. These are preferably selected from the group consisting of inorganic acids or bases, preferably from the group consisting of alkali metal or alkaline earth metal hydroxides, oxyacids or mixtures thereof, preferably alkali metal hydroxides, phosphoric acids or phosphoric acid derivatives or mixtures thereof, in particular sodium hydroxide, potassium hydroxide or phosphoric acid. Sodium hydroxide, potassium hydroxide or mixtures thereof are very particularly preferred.

These pH regulators are advantageously added to the lubricant compositions according to the invention such that the pH of the lubricant composition is between 6 and 10, preferably between 7 and 9, particularly preferably is 9.

In addition the lubricant compositions may also contain humectants which are preferably selected from the group consisting of alcohols, polyalcohols, polyols or mixtures thereof.

Glycerol, ethylene glycol, propylene glycol and polyethylene glycols having molar masses of less than 1000 g/mol are preferred.

It may also be advantageous to add a biocide to the lubricant composition. However, since the use of the compositions according to the invention makes it possible to reduce the use of biocides as indicated hereinabove it is possible (and preferred) for the lubricant compositions to contain not more than 1% by weight, preferably not more than 0.1% by weight, particularly preferably not more than 0.01% by weight, of biocides based on the total weight.

Biocides may preferably be selected from the group consisting of isothiazolinones, carbamates, formaldehyde, formaldehyde depot materials, phenols, phenol derivatives, alcohols, amines, quaternary ammonium compounds, alkali metal pyrithiones or mixtures thereof. Isothiazolinones, alkali metal pyrithiones, amine oxides and quaternary ammonium compounds or mixtures thereof are very particularly preferred.

The addition of a wetting agent may also be advantageous. Due to the advantages of the composition according to the invention (see above) even small amounts of a wetting agent may be sufficient to improve lubricating performance. Said agents may be selected from the group consisting of ionic, amphoteric, nonionic surfactants, polymer surfactants, detergents, soaps or mixtures thereof. Especially the use of an ionic surfactant, such as preferably a mixture of castor oil, ricinoleic acid and sulfuric acid esters and salts thereof ("Turkey red oil") results in lubricant compositions having particularly advantageous properties. The use of nonionic surfactants is preferably eschewed.

The wetting agent is advantageously present in the lubricant composition in an amount of not more than 2% by weight, preferably not more than 1% by weight, more preferably not more than 0.1% by weight, particularly preferably not more than 0.01% by weight based on the total weight of the lubricant composition.

Defoamers may optionally also be added. These are preferably selected from the group consisting of silicones, siloxanes, organosiloxanes, phosphoric esters, mono- and diglycerides of edible fatty acids or mixtures thereof. Siloxanes, organosiloxanes or mixtures thereof are preferred.

The lubricant composition advantageously contains not only a pH regulator but also a humectant and an anticorrosion agent.

Particularly preferred embodiments of the composition and lubricant composition according to the invention are described hereinbelow.

In one embodiment the lubricant composition contains the following components/is obtainable by combination of the following components:

20% to 70% by weight of water,
30% to 80% by weight of component (A),
0% to 10% by weight of a pH regulator,
0% to 5% by weight of an anticorrosion agent and
0% to 5% by weight of a humectant in each case based on the total weight of the lubricant composition.

In a further embodiment the lubricant composition contains the following components/is obtainable by combination of the following components:

20% to 70% by weight of water,
30% to 80% by weight of component (A),
0.1% to 2.5% by weight of at least one metal salt (M),
0% to 10% by weight of a pH regulator,
0% to 2% by weight of a nonferrous inhibitor,
0% to 5% by weight of an anticorrosion agent and
0% to 5% by weight of a humectant in each case based on the total weight of the lubricant composition.

In a further embodiment the lubricant composition contains the following components/is obtainable by combination of the following components:

20% to 70% by weight of water,
30% to 80% by weight of component (B),
0% to 10% by weight of a pH regulator,
0% to 5% by weight of an anticorrosion agent and
0% to 5% by weight of a humectant in each case based on the total weight of the lubricant composition.

In a further embodiment the lubricant composition contains the following components/is obtainable by combination of the following components:

20% to 70% by weight of water,
30% to 80% by weight of component (B),
0.1% to 2.5% by weight of at least one metal salt (M),
0% to 10% by weight of a pH regulator,
0% to 2% by weight of a nonferrous inhibitor,
0% to 5% by weight of an anticorrosion agent and
0% to 5% by weight of a humectant in each case based on the total weight of the lubricant composition.

In an alternative embodiment the lubricant composition contains the following components/is obtainable by combination of the following components:

20% to 70% by weight of water,
20% to 60% by weight of component (A),
5% to 30% by weight of component (B),
0% to 10% by weight of a pH regulator,
0% to 5% by weight of an anticorrosion agent and
0% to 5% by weight of a humectant in each case based on the total weight of the lubricant composition.

In a further alternative embodiment the lubricant composition contains the following components/is obtainable by combination of the following components:

20% to 70% by weight of water,
20% to 60% by weight of component (A),
5% to 30% by weight of component (B),
0.1% to 2.5% by weight of at least one metal salt (M),
0% to 10% by weight of a pH regulator,
0% to 2% by weight of a nonferrous inhibitor,
0% to 5% by weight of an anticorrosion agent and
0% to 5% by weight of a humectant in each case based on the total weight of the composition.

In another embodiment the lubricant composition contains the following components/is obtainable by combination of the following components:

50% to 95% by weight of water,
5% to 50% by weight of component (A),
0% to 5% by weight of a pH regulator,
0% to 1% by weight of an anticorrosion agent and
0% to 1% by weight of a humectant in each case based on the total weight of the lubricant composition.

In a further embodiment the lubricant composition contains the following components/is obtainable by combination of the following components:

50% to 95% by weight of water,
5% to 50% by weight of component (B),
0% to 5% by weight of a pH regulator,
0% to 1% by weight of an anticorrosion agent and
0% to 1% by weight of a humectant in each case based on the total weight of the lubricant composition.

In one embodiment the lubricant composition contains the following components/is obtainable by combination of the following components:

50% to 95% by weight of water,
5% to 30% by weight of component (A),
5% to 30% by weight of component (B),
0% to 5% by weight of a pH regulator,
0% to 1% by weight of an anticorrosion agent and
0% to 1% by weight of a humectant in each case based on the total weight of the lubricant composition.

In another alternative embodiment the lubricant composition contains the following components/is obtainable by combination of the following components:

50% to 95% by weight of water,
30% to 80% by weight of component (A),
5% to 50% by weight of component (B),
0.1% to 2.5% by weight of a first metal salt (M),
0.5% to 2% by weight of a second metal salt (M),
0% to 5% by weight of a pH regulator,
0% to 2% by weight of a nonferrous inhibitor,
0% to 1% by weight of an anticorrosion agent and
0% to 1% by weight of a humectant in each case based on the total weight of the lubricant composition.

In one aspect of the invention the composition according to the invention comprises the following components/the composition is obtainable by combination of the following components:

50% to 90% by weight of component (A),
0% to 10% by weight of a pH regulator,
0% to 20% by weight of a humectant and
0% to 10% by weight of an anticorrosion agent in each case based on the total weight of the composition.

In a further aspect of the invention the composition according to the invention comprises the following components/the composition is obtainable by combination of the following components:

50% to 90% by weight of component (B),
0% to 10% by weight of a pH regulator,
0% to 20% by weight of a humectant and
0% to 10% by weight of an anticorrosion agent in each case based on the total weight of the composition.

In an alternative aspect the composition comprises the following components/is obtainable by combination of the following components:

40% to 90% by weight of component (A),
10% to 40% by weight of component (B),
0% to 30% by weight of a pH regulator,
0% to 10% by weight of a humectant and
0% to 10% by weight of an anticorrosion agent in each case based on the total weight of the composition.

It has been found that the lubricant compositions according to the invention exhibit good performance in the four-ball apparatus (VKA) for determining weld load according to DIN 51350-2. These lubricant compositions further achieve good performance in the so-called cross-cylinder test (XCT).

Good performance was likewise demonstrated in the tapping torque test (TTT). It was found that the addition of a humectant, in particular glycerol, has an advantageous effect on performance in the TTT. The tests were performed based on the guideline (ASTM D 5619) (Example 3). By capturing torque and temperature data this test system provides evidence about decisive process parameters during forming and subtractive manufacturing processes.

Use of the lubricant compositions according to the invention, in particular as a lubricant solution, in addition allows for simplified monitoring of process management, especially in respect of the consumption or loss of lubricant components. The utilization of precisely one solution thus has the advantage that customary methods such as spectrometric, titrimetric or electroanalytical processes may be employed to determine and to monitor the concentration of the components (A) and/or (B) in particular. This allows simple detection (monitoring) of the consumption of lubricant components, in particular of the components (A) and/or (B), during the metalworking process.

To this end the lubricant composition may be introduced into a detection unit for example to determine the consumption of components of the lubricant composition after contact with the material. The detection unit may also directly or indirectly be part of the metalworking apparatus.

In a further aspect the invention thus relates to a process for quality control of lubricant compositions in a metalworking process comprising the steps of:

(i) providing a lubricant composition according to the invention
(ii) contacting the material with the lubricant composition
(iii) determining the concentration of at least one component of the lubricant composition, in particular of the components (A) and/or (B) and at least one metal salt (M), advantageously using a spectrometric, titrimetric, chromatographic or electroanalytical process.

The lubricant composition used in this process may be employed in solid or liquid form. However, if the lubricant composition is applied to the workpiece in solid form it may be advantageous when said composition is converted into an aqueous solution before the determining of the components (A) and/or (B). Irrespective of the original state of matter of the lubricant composition said composition may be diluted with water for concentration determination.

A "spectrometric" process refers to a measurement based on spectroscopy. The term "spectroscopy" is to be understood as referring to a group of physical methods which in each case analyze a radiation for a particular property such as for example energy, mass or wavelength.

A "titrimetric" process refers to a method of measurement for quantitative determination of a substance by titration. "Titration" is a process in which a solution of known concentration is contacted with a sample of unknown concentration. The consumed volume of the solution is measured and the unknown concentration of the sample is calculated using the stoichiometry.

The term "electroanalytical" process refers to a method of measurement for quantitative determination of a substance by measurement of electric currents and/or voltages. This electroanalytical method is derived from the main categories of potentiometry, coulometry, amperometry or voltammetry (for example polarography).

The quantitative determination of a lubricant component may be followed by compensation of the consumption of the component by addition of a desired amount of this component ("post-addition"). This makes it possible to re-achieve a desired target value.

A further advantageous aspect of the invention thus relates to a process for controlling the concentration of lubricant components, in particular the components (A) and/or (B) and at least one metal salt (M), in a lubricant composition. A lubricant solution is advantageously concerned here.

It may accordingly be advantageous to connect the apparatus for metalworking with a reservoir tank either directly or indirectly (structurally or functionally).

It is optionally likewise possible to dilute the lubricant components with a liquid, preferably water, before these are added to the reservoir tank.

One aspect of the invention thus relates to a process for controlling the concentration of at least one component in a lubricant composition, in particular a lubricant solution, comprising the steps of:

(i) determining the concentration of the lubricant component (actual value), in particular at least one constituent of the component (A) and/or (B) and at least one metal salt (M) and (ii) post-addition of the component and/or of at least one metal salt (M) to a desired concentration (target value).

EXAMPLES

The invention is more particularly elucidated hereinbelow on the basis of experimental examples.

General Production Processes

Example 1—Production of Inventive Cooling Lubricant Compositions (KSS)

Solutions of the cooling lubricant compositions were produced.

| Solution 1 | % by weight |
|---|---|
| Water | 53.30 |
| Sodium disulfite | 16.00 |
| Sodium tripolyphosphate | 2.00 |
| Etidronic acid | 8.00 |
| Anticorrosion agent | 0.70 |
| pH regulator | 20.00 |

| Solution 2 | % by weight |
|---|---|
| Water | 44.30 |
| Sodium disulfite | 35.00 |
| Anticorrosion agent | 0.70 |
| pH regulator | 5.00 |
| Wetting agent | 15.00 |

Depending on the use the lubricant composition may be adjusted as desired to the desired concentration by further addition of water.

Synthesis Protocol

Initially the alkaline components are dissolved in water. This is optionally followed by addition of the acidic components. The pH is adjusted to the range of 6 to 10, preferably of 7 to 9, particularly preferably to 9, by addition of a pH regulator. This is optionally followed by addition of sulfur-containing components and readjustment of the pH to the desired range 8 to 10, in particular 9. This is optionally followed by addition of further additives, for example of biocides, wetting agents or humectants.

The following examples serve to elucidate diluted solutions as further possible embodiments:

| Solution 3 | % by weight |
|---|---|
| Water | 85.70 |
| Etidronic acid | 8.00 |
| Benzotriazole | 0.10 |
| Glycerol | 1.20 |
| Phosphoric acid | 5.00 |

| Solution 4 | % by weight |
|---|---|
| Water | 89.30 |
| Sodium tripolyphosphate | 5.00 |
| Etidronic acid | 1.50 |
| Benzotriazole | 0.10 |
| Glycerol | 1.10 |
| Phosphoric acid | 3.00 |

| Solution 5 | % by weight |
|---|---|
| Water | 90.20 |
| Sodium sulfite | 5.00 |
| Etidronic acid | 1.60 |
| Benzotriazole | 0.10 |
| Glycerol | 1.10 |
| Phosphoric acid | 2.00 |

Example 2—Determination of Surface Tension Using Example of Solution 1

Dynamic surface tension was determined by the bubble pressure method (based on an ASTM D 3825) using a tensiometer. To this end a cannula was used to introduce a gas into the inventive lubricant solution (solution 1, Example 1) and into water for comparison. The thus-formed bubble surface bulged and the bubble radius continuously decreased. The bubble pressure was used to determine the surface tension. By variation of the bubble formation rate the surface tension was determined as a function of surface age (dynamic surface tension determination).

A determination of static surface tension was carried out based on ASTM D 2285 by the droplet volume method.

This comprised determining the droplet number resulting from a specified liquid volume. Measurement was performed with the inventive lubricant composition (solution 1) and with water for comparison.

Both measurements with the inventive lubricant composition (solution 1) gave the result that no measurable reduction in surface tension compared to water was observed.

Example 3—Determination of Performance of the Lubricant Compositions

1. Production of the Test Cooling Lubricants

For determination of the weld load and determination of the Reichert value different lubricant compositions each containing 5% by weight of the inventive performance additives based on the total weight of the lubricant composition were produced (see KSS 1 to 5). As a comparative test a noninventive cooling lubricant emulsion (comparative example) was produced and compared to the inventive cooling lubricants in the following test methods.

The general synthesis of the cooling lubricants (KSS) was carried out according to the protocol previously described in Example 1.

| KSS 1 | % by weight |
|---|---|
| Water | 83.90 |
| Etidronic acid | 8.00 |
| Anticorrosion agent | 0.10 |
| Humectant | 1.00 |
| pH regulator | 7.00 |

| KSS 2 | % by weight |
|---|---|
| Water | 89.40 |
| Sodium tripolyphosphate | 5.00 |
| Sodium etidronate | 1.50 |
| Anticorrosion agent | 0.10 |
| Humectant | 1.00 |
| pH regulator | 3.00 |

| KSS 3 | % by weight |
|---|---|
| Water | 89.90 |
| Sodium sulfite | 5.00 |
| Sodium etidronate | 2.00 |
| Anticorrosion agent | 0.10 |
| Glycerol | 1.00 |
| pH regulator | 2.00 |

| KSS 4 | % by weight |
|---|---|
| Water | 88.90 |
| Etidronic acid | 8.00 |
| Anticorrosion agent | 0.10 |
| Humectant | 1.00 |
| pH regulator | 2.00 |

| KSS 5 | % by weight |
|---|---|
| Water | 92.00 |
| Sodium tripolyphosphate | 5.00 |
| Etidronic acid | 1.50 |
| Anticorrosion agent | 0.10 |
| Humectant | 1.00 |
| pH regulator | 0.40 |

| KSS 6 | % by weight |
|---|---|
| Water | 90.00 |
| Sodium sulfite | 5.00 |
| Etidronic acid | 2.00 |
| Anticorrosion agent | 0.10 |
| Humectant | 1.00 |
| pH regulator | 1.90 |

-continued

| Comparative example [cooling lubricant emulsion] | % by weight |
|---|---|
| Water | 92.10 |
| Performance additive | 2.30 |
| Buffer/stabilizer | 2.00 |
| Humectant | 0.50 |
| Wetting agent | 0.05 |
| Solubilizer | 2.40 |
| Anticorrosion agent | 0.50 |
| Biocide | 0.10 |
| Defoamer | 0.05 |

2. Procedure for Test Methods:

2.1. Determination of Torque During Thread Fabrication by the Tapping Torque Test System (TTT System) According to ASTM D5619

The torque during thread fabrication was determined at 25° C. and 800 rpm by means of a TTT system. The core of the TTT system is a torque-sensing thread fabrication unit supplemented with standardized measurement means (TTT standard) and evaluation and analysis software. The thread fabrication unit consists of a tool that is contacted with an aluminium block for thread forming. During the test predrilled holes were subjected to forming. The performance of the employed lubricant compositions was tested by capturing torque and temperature during thread fabrication using the following inventive test cooling lubricants (KSS 5 and 7).

| KSS 5 | % by weight |
|---|---|
| Water | 92.00 |
| Sodium tripolyphosphate | 5.00 |
| Etidronic acid | 1.50 |
| Anticorrosion agent | 0.10 |
| Humectant | 1.00 |
| pH regulator | 0.40 |

| KSS 7 | % by weight |
|---|---|
| Water | 83.30 |
| Etidronic acid | 8.00 |
| Benzotriazole | 0.10 |
| Glycerol | 0.60 |
| pH regulator | 8.00 |

Torque was determined as a value for the applied power. The lubricant composition to be tested was filled into the predrilled holes and the tool was contacted with the aluminium block.

2.2. Determination of Reichert Value in $N/Cm^2$

A test cylinder was contacted with a rotating test ring. The wear surface was elliptical in shape. To determine the scar diameter the main axes of the ellipse were measured and the projection surface of the wear surface was calculated from the diameter. The pressing load in conjunction with the projected wear coefficient thereupon gave the Reichert value in $N/cm^2$.

2.3. Determining Weld Load According to DIN 51350-2

The inventive test cooling lubricants (KSS 1 to 6) were tested in a four-ball system (DIN 51350-1) which consisted of a rotating ball (moving ball) which, under a specified test load, slid against three identical balls (stationary balls). The test load was increased in stages until welding of the four-ball system occurred.

Procedure

The ball pot or ball holder, consisting of a clamp, pressure plate and test balls was carefully cleaned and dried in water and a residueless solvent, preferably FAM benzine.

The cleaned ball head is provided with three cleaned stationary balls and firmly clamped with a clamping apparatus. The ball pot is subsequently filled with the lubricant composition in the absence of any air bubbles. The ball pot was filled such that the stationary balls were covered and the ball holder of the moving ball was not immersed in the lubricant. The ball pot and the lubricant composition had a temperature between 18° C. and 40° C. The moving ball was pressed into the ball holder at the motor axis. After placing the point of the spindle of the ball pot into the depression on the turntable the test load was applied, wherein the test load was adjusted according to defined load stages from 2000 N to not more than 7000 N. In addition the drive motor was set to 1450 revolutions per minute.

To determine the weld load the test load was increased until welding of the balls took place.

3. Evaluation of Test Results 3.1. Tapping Torque Test (TTT)

The torque data were only evaluated if a successful forming had been carried out. The required torque for thread forming was not allowed to exceed a maximum value. Values above this maximum value were not detected. If possible the test was repeated seven times and the average maximum torque was determined. The results for the different test cooling lubricants are apparent from Table 1:

TABLE 1

Evaluation of tapping torque test

| Lubricant composition | Number of bores | Average torque [Ncm] |
|---|---|---|
| KSS 7 | 7 | 69 |
| KSS 8 | 7 | 69 |
| Comparative example | 7 | 76 |

3.2. Cross-Cylinder Test (XCT)

The Reichert values determined from the wear scar of a steel cylinder are summarized in Table 2.

TABLE 2

Test results from the cross-cylinder test

| Lubricant composition | Reichert value [N/m$^2$] |
|---|---|
| KSS 1 | 5430 |
| KSS 2 | 37095 |
| KSS 3 | 32835 |
| KSS 4 | 5430 |
| KSS 5 | 37095 |
| KSS 6 | 32835 |
| Comparative example | 2751 |

3.3. Four Ball Apparatus (VKA)

The VKA weld load of a lubricant composition was determined from two concurrent individual measured values from in each case three tests for weld load. Table 3 summarizes the thus-obtained results by reporting weld load in newtons N:

TABLE 3

Test results of VKA weld load for KSS

| Lubricant composition | Weld load [N] |
|---|---|
| KSS 1 | 7000 |
| KSS 2 | 6500 |
| KSS 3 | 2800 |
| KSS 4 | 7000 |
| KSS 5 | 6500 |
| KSS 6 | 2800 |
| Comparative example | <2000 |

Example 3—Determination of Corrosion Properties of Cooling Lubricants on Iron Filings According to DIN 51360-2

Procedure

To test the corrosion properties of the cooling lubricants different cooling lubricant solutions of different concentration were initially produced as described in Example 3. In addition, iron filings were placed on a filter paper in a petri dish. Subsequently, 2 mL of the lubricant compositions to be investigated were deposited on the iron filings. After 2 hours the lubricant composition and the iron filings were removed.

Evaluation

The filter paper was subjected to visual assessment in respect of any rust residues.

FIG. 1 shows the corrosion properties of the test cooling lubricant solutions according to concentration.

Visual evaluation showed that above a critical concentration of at least 5% by weight of the performance additive in the lubricant compositions no corrosion is observed. At lower concentrations of for example 1% by weight the iron filings were corroded.

Example 4—Determination of Re-Solubility 5 g of the produced solutions were initially dried at room temperature in a crystallizing dish. Solubility was reconstructed by addition of 5 g of water to the dried lubricant compositions and the time until formation of a clear solution was detected. If the experiment is performed without swirling the solution after addition of 5 g of water, the time until re-solution is <10 minutes. When the samples were gently swirled after addition of water complete re-solution was already achieved after <5 minutes.

Figure 2:
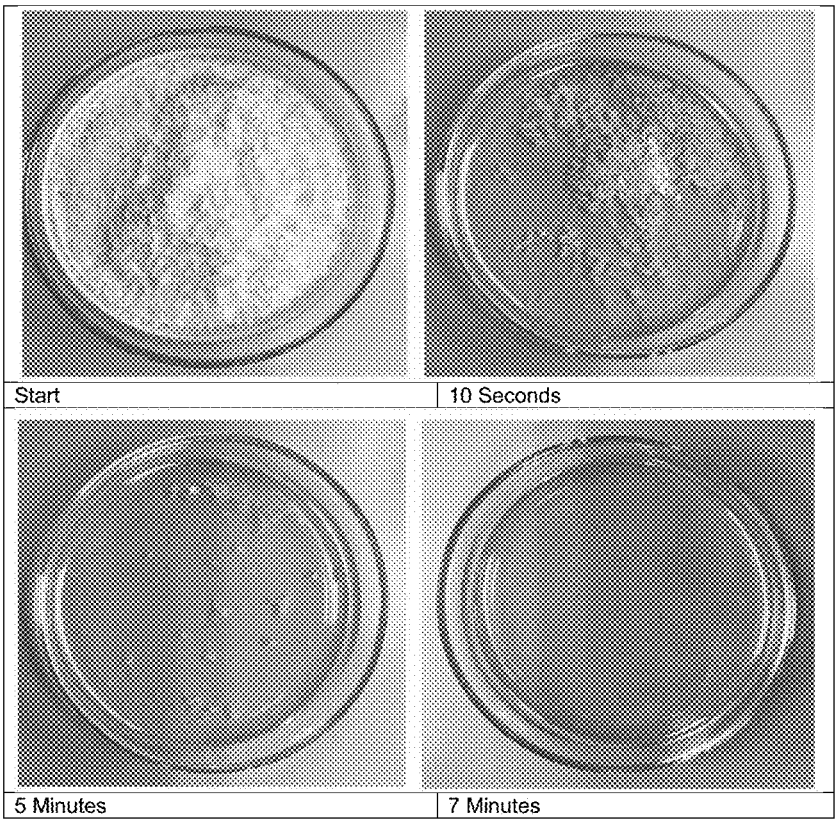
FIG. 2 elucidates the results of performing the re-solution test without swirling the solution.

FIG. 2 elucidates the results of performing the re-solution test without swirling the solution.

Complete re-solubility was ensured. A large part of the components was already dissolved after 10 seconds. Complete re-solution of the components was observed after 7 minutes.

Example 5—Determination of Hard Water Stability

For determination of hard water stability the inventive solutions 1 and 2 were diluted with water of different hardnesses to afford solutions comprising 5% by weight of the inventive composition. These solutions were tested for transparency and stability.

All tested lubricant compositions were clear, transparent and stable up to a hardness of 80° dH.

Example 6—Foam Test

To perform the shaking foam test 50 mL of the inventive composition to be investigated (solutions 1 and 2 and KSS 1 to 6) were filled into a mixing cylinder. The lubricant solution was subsequently vigorously manually shaken 10 times.

The investigated inventive solutions as well as the test cooling lubricants showed no foam formation.

Example 7—Biostability Test

To perform the biostability test the lubricant compositions according to the invention (solutions 1, Example 1) are inoculated with a contaminated sample. Immediately after addition of the contaminated sample the contamination was also observable in the solution 1. This disappeared again during the first 5 to 7 inoculations. Only from the 8th cycle onwards was a permanent germ load observed. However, independent germ growth without inoculation was not observed over a period of at least 10 weeks.

4.1. pH Stability Tests pH stability of an inventive lubricant composition was achieved by addition of at least one metal salt. To this end investigations into the influence of the metal ions (here iron ions) on the pH stability of an aqueous lubricant composition were performed. Elemental iron (in the form of filings and/or powder) was in each case added to an inventive lubricant composition in an open glass beaker.

A lubricant composition without addition of metal salt (M) (cf. Table 4) (as a comparative batch) and altogether four lubricant compositions (cf. Tables 5 and 6) with increasing metal salt content (and thus an increasing proportion of metal ions) were investigated.

These mixtures were left standing in air. The pH was in each case measured daily to one decimal place at commencement (day 0) and on days 1 to 5.

| Lubricant composition A: | |
|---|---|
| Lubricant composition A | Content % by wt. |
| Potassium tripolyphosphate | 5-10 |
| Benzotriazole | 0.05 |
| phosphoric acid (75%) | 1.7 |

After addition of water the pH was adjusted with 50% NaOH.

TABLE 4

Comparative example-pH stability test of a composition (composition A, without metal salt (M)) Lubricant composition A 10% Open glass beaker with 20 g iron filings Total amount 200 g

| | Day 0 | Day 1 | Day 2 | Day 3 | Day 4 | Day 5 |
|---|---|---|---|---|---|---|
| pH | 9.0 | 9.6 | 10.3 | —/— | —/— | 10.6 |

TABLE 5

Test results-pH stability test of the inventive composition (composition A + metal salt(s) (M) at different concentrations-2000-3000 ppm of Fe ions) Content: 3000 ppm Fe II/Fe III 2 to 1 Lubricant composition A 10% Open glass beaker with 20 g iron filings Total amount 200 g

| | Day 0 | Day 1 | Day 2 | Day 3 | Day 4 | Day 5 |
|---|---|---|---|---|---|---|
| pH | 9.0 | 8.9 | 9.1 | —/— | —/— | 9.0 |

The effect of pH stabilization by metal ions is apparent in Table 6. In that example the pH is stable over two weeks.

It is also apparent that a ratio of the ions of the metal salt of $Fe^{2+}$ to $Fe^{3+}$ of 2:1 is particularly advantageous.

TABLE 6

Test results-pH stability test of the inventive composition (composition A + metal salt(s) (M) - 5000 ppm of Fe ions)

| | Fe II | Fe III | Fe II/ Fe III (1:2) | Fe II/ Fe III (1:1) | Fe II/ Fe III (2:1) |
|---|---|---|---|---|---|
| 20 g iron filings/200 g (10% lubricant composition A) | | | | | |
| Day 0 | 9.0 | 9.0 | 9.0 | 9.0 | 9.0 |
| Day 14 | 9.9 | 9.4 | 9.3 | 9.3 | 9.1 |
| 20 g iron filings/2 g iron powder/200 g (10% lubricant composition A) | | | | | |
| Day 0 | 9.0 | 9.0 | 9.0 | 9.0 | 9.0 |
| Day 14 | 10.5 | 9.7 | 9.3 | 9.4 | 9.1 |

EMBODIMENTS

Embodiment 1

Composition for producing a lubricant composition containing a component (A) or a component (B) or mixtures thereof, wherein component (A) consists of one or more inorganic salts and component (B) consists of one or more compounds comprising at least one structural unit XC, in which C=carbon and X=silicon, nitrogen, phosphorus or sulfur and X and C are bonded to one another by means of a σ-bond, π-bond or ionic bond, wherein the composition forms a homogeneous solution upon addition of water.

Embodiment 2

Composition obtainable by combination of at least two inorganic salts of the component (A) or at least two compounds of the component (B) as defined in embodiment 1 or of at least one inorganic salt of the component (A) and at least one compound of the component (B) as defined in embodiment 1.

Embodiment 3

Composition according to embodiment 1 or 2, wherein the surface tension of water is reduced by not more than 10%, preferably not more than 5%, particularly preferably not more than 2%, upon addition of the composition.

Embodiment 4

Composition according to any of the preceding embodiments, wherein the composition contains, preferably consists of, component (A) and component (B).

Embodiment 5

Composition according to embodiment 4, wherein the weight ratio between component (A) and component (B) is at least 40:60, preferably at least 50:50, more preferably at least 60:40, particularly preferably at least 70:30, in particular at least 80:20.

Embodiment 6

Composition according to embodiment 4 or 5, wherein at least 40% by weight of the component (A), preferably at least 50% by weight of the component (A), more preferably at least 60% by weight of the component (A), particularly preferably at least 80% by weight of the component (A), in particular at least 90% by weight of the component (A), based on the total weight of the components (A) and (B) are present.

Embodiment 7

Composition according to any of the preceding embodiments, wherein the components (A) and (B) each have a solubility in water at 25° C. of at least 25 g/L, preferably of at least 50 g/L, more preferably of at least 100 g/L, particularly preferably of 200 g/L, especially preferably of at least 500 g/L.

Embodiment 8

Composition according to any of the preceding embodiments, wherein component (A) contains sulfur (S), nitrogen (N), phosphorus (P) or mixtures thereof, preferably sulfur (S) or phosphorus (P) or mixtures thereof.

Embodiment 9

Composition according to any of the preceding embodiments, wherein component (A) contains a group selected from sulfide, sulfite, sulfate, thiosulfate, disulfite, tetrathionate, sulfonate, ammonium, nitride, nitrate, phosphide, phosphite, phosphate, diphosphate, polyphosphate, pyrophosphate, metaphosphate or salts or mixtures thereof, preferably from sulfite, disulfite, thiosulfate, phosphate, polyphosphate, pyrophosphate, metaphosphate or salts or mixtures thereof; component (A) is especially selected from sodium sulfite, sodium disulfite, sodium thiosulfate, sodium phosphate, sodium tripolyphosphate, sodium pyrophosphate, sodium hexametaphosphate or mixtures thereof.

Embodiment 10

Composition according to any of the preceding embodiments, wherein the component (B) is selected from the group consisting of organophosphorus, organosulfur, organonitrogen compounds or mixtures thereof, preferably from organophosphorus, organosulfur compounds or mixtures thereof, particularly preferably from organophosphorus or organosulfur compounds, in particular organophosphorus compounds.

Embodiment 11

Composition according to any of the preceding embodiments, wherein component (B) contains at least one group selected from the group consisting of sulfate, thiosulfate, disulfite, tetrathionate, sulfonate, phosphate, phosphonate, bisphosphonate, oligophosphonate, polyphosphonate, ammonium or salts or mixtures thereof, preferably from sulfate, sulfonate, phosphate, phosphonate, bisphosphonate, oligophosphonate, polyphosphonate or salts or mixtures thereof, particularly preferably from phosphonate, bisphosphonate, oligophosphonate, polyphosphonate or salts or mixtures thereof; in particular the component (B) is selected from the group of bisphosphonates or salts thereof.

Embodiment 12

Composition according to any of the preceding embodiments, wherein component (B) contains at least one compound selected from the group consisting of 1-hydroxyalkane-1,1-diphosphonic acid, 1-hydroxyalkene-1,1-diphosphonic acid, 1-aminoalkane-1,1-diphosphonic acid, 1-hydroxy-3-aminoalkane-1,1-diphosphonic acid, 3-amino-1-hydroxyalkane-1,1-diphosphonic acid, 1-hydroxy-4-aminoalkane-1,1-diphosphonic acid, 1-amino-4-hydroxyalkane-1,1-diphosphonic acid, alkylamino-1-hydroxyalkane-1,1-diphosphonic acid or salts thereof or mixtures thereof, preferably 1-hydroxyalkane-1,1-diphosphonic acid, 1-aminoalkane-1,1-diphosphonic acid, 3-amino-1-hydroxyalkane-1,1-diphosphonic acid, 1-hydroxy-3-aminoalkane-1,1-diphosphonic acid, alkylamino-1-hydroxyalkane-1,1-diphosphonic acid or salts thereof or mixtures thereof, more preferably 1-hydroxymethane-1,1-diphosphonic acid, 1-hydroxyethane-1,1-diphosphonic acid, 1-hydroxypropane-1,1-diphosphonic acid, 3-amino-1-hydroxypropane-1,1-diphosphonic acid, 1-hydroxybutane-1,1-diphosphonic acid, 1-hydroxy-3-aminopropane-1,1-diphosphonic acid, 4-dialkylamino-1-hydroxybutane-1,1-diphosphonic acid or salts thereof or mixtures thereof, particularly preferably 1-hydroxyethane-1,1-diphosphonic acid, 1-hydroxypropane-1,1-diphosphonic acid, 3-amino-1-hydroxypropane-1,1-diphosphonic acid or salts thereof or mixtures thereof, in particular 1-hydroxyethane-1,1-diphosphonic acid or salts thereof or mixtures thereof.

Embodiment 13

Composition according to any of the preceding embodiments, wherein component (B) is selected from etidronic acid, sodium or potassium etidronate or mixtures thereof.

Embodiment 14

Composition according to any of the preceding embodiments 1 to 13, wherein said composition is solid.

Embodiment 15

Composition according to any of the preceding embodiments, wherein said composition contains an anticorrosion agent which is preferably selected from the group consisting of triazoles, thiadiazoles, organophosphoric acids, boric acid, boric acid derivatives, sulfonic acids, sulfonates, sulfonic acid esters, carboxylic acids or mixtures thereof, particularly preferably from benzotriazole, benzothiadiazole, maleic acid, malonic acid, isononanoic acid, citric acid, ascorbic acid or mixtures thereof, especially preferably is benzotriazole.

Embodiment 16

Composition according to embodiment 14, wherein the anticorrosion agent is present in an amount of not more than 10% by weight, preferably not more than 5% by weight, more preferably not more than 2% by weight, particularly preferably not more than 1% by weight, in particular not more than 0.1% by weight, based on the total weight of the composition.

Embodiment 17

Composition according to any of the preceding embodiments, wherein said composition contains a humectant which is preferably selected from the group consisting of alcohols, polyalcohols, polyols or mixtures thereof, particularly preferably from glycerol, ethylene glycol, propylene glycol and polyethylene glycols having molar masses of less than 1000 g/mol, especially preferably is glycerol.

Embodiment 18

Composition according to any of the preceding embodiments, wherein said composition contains a pH regulator which is preferably selected from the group consisting of inorganic acids or bases, more preferably from the group consisting of alkali metal or alkaline earth metal hydroxides, oxyacids or mixtures thereof, particularly preferably alkali metal hydroxides, phosphoric acids or phosphoric acid derivatives or mixtures thereof, in particular sodium hydroxide, potassium hydroxide, phosphoric acid or mixtures thereof.

Embodiment 19

Composition according to any of the preceding embodiments containing the following components or obtainable by combination of the following components:

50% to 90% by weight of component (A),
0% to 10% by weight of a pH regulator,
0% to 20% by weight of a humectant and
0% to 10% by weight of an anticorrosion agent in each case based on the total weight of the composition.

Embodiment 20

Composition according to any of the preceding embodiments containing the following components or obtainable by combination of the following components:

50% to 90% by weight of component (B),
0% to 10% by weight of a pH regulator,
0% to 20% by weight of a humectant
0% to 10% by weight of an anticorrosion agent in each case based on the total weight of the composition.

Embodiment 21

Composition according to any of the preceding embodiments containing the following components or obtainable by combination of the following components:

40% to 90% by weight of component (A),
10% to 40% by weight of component (B),
0% to 30% by weight of a pH regulator,
0% to 10% by weight of a humectant and
0% to 10% by weight of an anticorrosion agent in each case based on the total weight of the composition.

Embodiment 22

Use of a composition according to any of the preceding embodiments for producing a cooling lubricant solution, wherein said composition is in the form of a tablet or powder.

Embodiment 23

Use of a composition according to any of the preceding embodiments as a performance additive in cooling lubricants.

Embodiment 24

Use of a composition according to any of the preceding embodiments 1 to 21 as a performance additive in subtractive metalworking.

Embodiment 25

Lubricant composition containing the following components or obtainable by combination of the following components:

20% to 70% by weight of water,
30% to 80% by weight of component (A),
0% to 10% by weight of a pH regulator,
0% to 5% by weight of an anticorrosion agent and
0% to 5% by weight of a humectant in each case based on the total weight of the lubricant composition.

Embodiment 26

Lubricant composition containing the following components or obtainable by combination of the following components:

20% to 70% by weight of water,
30% to 80% by weight of component (B),
0% to 10% by weight of a pH regulator,
0% to 5% by weight of an anticorrosion agent and
0% to 5% by weight of a humectant in each case based on the total weight of the lubricant composition.

Embodiment 27

Lubricant composition containing the following components or obtainable by combination of the following components:

20% to 70% by weight of water,
20% to 60% by weight of component (A),
5% to 30% by weight of component (B),
0% to 10% by weight of a pH regulator,
0% to 5% by weight of an anticorrosion agent and
0% to 5% by weight of a humectant in each case based on the total weight of the lubricant composition.

Embodiment 28

Lubricant composition containing the following components or obtainable by combination of the following components:

50% to 95% by weight of water,
5% to 50% by weight of component (A),
0% to 5% by weight of a pH regulator,
0% to 1% by weight of an anticorrosion agent and
0% to 1% by weight of a humectant in each case based on the total weight of the lubricant composition.

Embodiment 29

Lubricant composition containing the following components or obtainable by combination of the following components:

50% to 95% by weight of water,

5% to 50% by weight of component (B),

0% to 5% by weight of a pH regulator,

0% to 1% by weight of an anticorrosion agent and

0% to 1% by weight of a humectant in each case based on the total weight of the lubricant composition.

Embodiment 30

Lubricant composition containing the following components or obtainable by combination of the following components:

50% to 95% by weight of water,

5% to 30% by weight of component (A),

5% to 30% by weight of component (B),

0% to 5% by weight of a pH regulator,

0% to 1% by weight of an anticorrosion agent and

0% to 1% by weight of a humectant in each case based on the total weight of the lubricant composition.

Embodiment 31

Lubricant composition according to any of the preceding embodiments 25 to 30, wherein said composition contains a wetting agent which is preferably selected from the group consisting of ionic, amphoteric, nonionic surfactants, polymer surfactants, detergents, soaps or mixtures thereof, in particular from castor oil, ricinoleic acid and sulfuric acid esters and salts thereof or mixtures thereof.

Embodiment 32

Lubricant composition according to embodiment 31, wherein the wetting agent is present in an amount of not more than 2% by weight, preferably not more than 1% by weight, more preferably not more than 0.1% by weight, particularly preferably not more than 0.01% by weight, based on the total weight of the lubricant composition.

Embodiment 33

Lubricant composition according to any of the preceding embodiments 25 to 32, wherein said composition contains a biocide which is preferably selected from the group consisting of isothiazolinones, carbamates, formaldehyde, formaldehyde depot materials, phenols, phenol derivatives, alcohols, amines, quaternary ammonium compounds, alkali metal pyrithiones or mixtures thereof, particularly preferably from isothiazolinones, alkali metal pyrithiones, amine oxides and quaternary ammonium compounds or mixtures thereof.

Embodiment 34

Lubricant composition according to embodiment 33, wherein the biocide is present in an amount of not more than 1% by weight, preferably not more than 0.1% by weight, particularly preferably not more than 0.01% by weight, based on the total weight of the lubricant composition.

Embodiment 35

Lubricant composition according to any of the preceding embodiments 25 to 34, wherein the pH of the solution is in the range from 6 to 10, preferably from 7 to 9, particularly preferably is 9.

Embodiment 36

Lubricant composition according to any of the preceding embodiments 25 to 35, wherein no nonionic surfactants are present.

Embodiment 37

Lubricant composition according to any of the preceding embodiments 25 to 36, wherein said composition contains no oil, wax or fat, preferably no natural or synthetic wax, in particular no microcrystalline wax, paraffin wax, polyethylene wax, polypropylene wax, carnauba wax or mixtures thereof.

Embodiment 38

Use of a lubricant composition according to any of the preceding embodiments 25 to 37 as a cooling lubricant in metalworking, in particular in subtractive metalworking.

Embodiment 39

Process for producing a lubricant tab comprising the steps of (i) providing a composition according to any of the preceding embodiments 1 to 21;

(ii) compacting the lubricant composition by compaction, in particular roller compaction;

(iii) granulating the lubricant composition; and (iv) compressing the granulates into tablets.

Embodiment 40

Process for producing a lubricant composition comprising the steps of (i) providing a composition according to any of the preceding embodiments 1 to 21;

(ii) mixing the composition with water.

Embodiment 41

Process for quality control of lubricant compositions in a metalworking process comprising the steps of:

(i) providing a lubricant composition according to any of the preceding embodiments 25 to 37;

(ii) contacting the material with the lubricant composition;

(iii) determining the concentration of at least one component of the lubricant composition, in particular of the components (A) and/or (B) according to any of the preceding embodiments, preferably using a spectrometric, titrimetric or electroanalytical process.

Embodiment 42

Process for post-addition of a lubricant composition comprising the steps of:

(i) determining the concentration of the lubricant component (actual value), in particular at least one constituent of the component (A) and/or (B) according to any of the preceding embodiments, and (ii) post-addition of the component to a desired concentration (target value).

The invention claimed is:

1. A composition obtainable by combining a component (A) and at least two metal salts (M) and water, component (A) consisting of one or more inorganic salts selected from sulfite, disulfite, thiosulfate, phosphate, polyphosphate, pyrophosphate, metaphosphate or salts or mixtures thereof, wherein the metal salts (M) differ in the oxidation number of the metal and the metal is Fe, wherein the concentration of component (A) is in the range from 5% to 20% by weight based on the total weight of the lubricant composition, and the total concentration of the metal salts (M) is in the range from 5% to 10% by weight based on the total weight of the lubricant composition, wherein the composition is a lubricant solution and has a pH of 9 to 10.

2. The composition according to claim 1, wherein two different metal salts (M) are present in a ratio between 10:1 and 1:10.

3. The composition according to claim 1, wherein one metal has the oxidation state (II+) and one metal has the oxidation state (III+).

4. The composition according to claim 1, wherein one metal has the oxidation state (II+) and one metal has the oxidation state (III+), and the metal salt (M) containing Fe(II+) is present in a molar ratio of between 5:1 and 1:5, to a second metal salt (M) containing Fe(III+).

5. The composition according to claim 1, wherein at least one metal salt (M) is selected from iron sulfate, ammonium iron sulfate, ammonium iron citrate, ammonium iron oxalate, iron citrate, iron oxalate and/or hydrates thereof or mixtures thereof.

6. The composition according to claim 1, wherein component (A) comprises at least one alkali metal or alkaline earth metal.

7. The composition according to claim 1, wherein component (A) comprises at least one inorganic salt selected from potassium sulfite, potassium disulfite, potassium thiosulfate, potassium phosphate, potassium tripolyphosphate, potassium pyrophosphate, potassium hexametaphosphate or mixtures thereof.

8. The composition according to claim 1, wherein component (A) comprises potassium tripolyphosphate and the metal salt (M) comprises iron sulfate, ammonium iron sulfate, ammonium iron citrate, ammonium iron oxalate, iron citrate, iron oxalate and/or hydrates thereof or mixtures thereof.

9. The composition according to claim 1, wherein the surface tension of water, measured according to ASTM D 1331, is reduced by not more than 10%.

10. The composition according to claim 1, wherein it additionally contains a component (B), wherein component (B) consists of one or more compounds comprising at least one structural unit XC, in which C=carbon and X=silicon, nitrogen, oxygen, phosphorus or sulfur and X and C are bonded to one another by means of a σ-bond, π-bond or ionic bond.

11. The composition according to claim 1, wherein it additionally contains a component (B), wherein component (B) consists of one or more compounds comprising at least one structural unit XC, in which C=carbon and X=silicon, nitrogen, oxygen, phosphorus or sulfur and X and C are bonded to one another by means of a σ-bond, π-bond or ionic bond, and component (B) contains at least one group selected from sulfonate, phosphonate, bisphosphonate, polyphosphonate, ammonium or salts or mixtures thereof.

12. The composition according to claim 1, wherein the metal salt (M) comprises at least one counterion selected from sulfate, ammonium, acetate, citrate, oxalate, phosphate or mixtures thereof.

13. The composition according to claim 1, wherein one metal has the oxidation state (II+) and one metal has the oxidation state (III+), and the metal salt (M) containing Fe(II+) is present in a molar ratio of between 2:1 and 1:2, to a second metal salt (M) containing Fe(III+).

14. The composition according to claim 1, wherein at least one metal salt (M) is an iron sulfate and/or hydrates thereof.

15. The composition according to claim 1, wherein component (A) is selected from phosphate, polyphosphate, metaphosphate or salts or mixtures thereof.

16. The composition according to claim 1, wherein component (A) comprises at least one alkali metal.

17. The composition according to claim 1, wherein it additionally contains a component (B), wherein component (B) consists of one or more compounds comprising at least one structural unit XC, in which C=carbon and X=silicon, nitrogen, oxygen, phosphorus or sulfur and X and C are bonded to one another by means of a σ-bond, π-bond or ionic bond, and component (B) contains at least one group selected from etidronic acid, sodium or potassium etidronate or mixtures thereof.

18. The composition according to claim 1, wherein the pH is stable over two weeks.

19. The composition according to claim 10, wherein the concentration of component (A) and component (B) is in the range from 5% to 20% by weight based on the total weight of the lubricant composition, and the total concentration of the metal salts (M) is in the range from 5% to 10% by weight based on the total weight of the lubricant composition.

* * * * *